US011319957B2

(12) United States Patent
Hu et al.

(10) Patent No.: US 11,319,957 B2
(45) Date of Patent: May 3, 2022

(54) SCROLL COMPRESSOR AND VEHICLE HAVING THE SAME

(71) Applicant: GREE GREEN REFRIGERATION TECHNOLOGY CENTER CO., LTD. OF ZHUHAI, Guangdong (CN)

(72) Inventors: Yusheng Hu, Zhuhai (CN); Caixia Shan, Zhuhai (CN); Gang Lv, Zhuhai (CN); Qi Fang, Zhuhai (CN); Shuanglai Liu, Zhuhai (CN); Shuangshuang Chu, Zhuhai (CN); Yuchen Zhao, Zhuhai (CN)

(73) Assignee: GREE GREEN REFRIGERATION TECHNOLOGY CENTER CO., LTD. OF ZHUHAI, Guangdong (CN)

( * ) Notice: Subject to any disclaimer, the term of this patent is extended or adjusted under 35 U.S.C. 154(b) by 0 days.

(21) Appl. No.: 17/253,579

(22) PCT Filed: Dec. 12, 2018

(86) PCT No.: PCT/CN2018/120640
§ 371 (c)(1),
(2) Date: Dec. 17, 2020

(87) PCT Pub. No.: WO2020/006985
PCT Pub. Date: Jan. 9, 2020

(65) Prior Publication Data

US 2021/0140429 A1 May 13, 2021

(30) Foreign Application Priority Data

Jul. 3, 2018 (CN) ..... 201810717749.6

(51) Int. Cl.
*F04C 18/02* (2006.01)
*F04C 29/02* (2006.01)

(52) U.S. Cl.
CPC ..... *F04C 18/0215* (2013.01); *F04C 29/02* (2013.01); *F04C 2240/50* (2013.01)

(58) Field of Classification Search
CPC ..... F01C 17/06; F04C 18/0215; F04C 29/02; F04C 29/028; F04C 2240/50; F04C 2240/60; F04C 2240/603
See application file for complete search history.

(56) References Cited

U.S. PATENT DOCUMENTS 5,391,066 A * 2/1995 Sawai ..... F04C 29/026 418/55.6
11,067,080 B2 * 7/2021 Mesward ..... F04C 18/0215
(Continued)

FOREIGN PATENT DOCUMENTS

CN 101550934 A 10/2009
CN 103835945 A 6/2014
(Continued)

OTHER PUBLICATIONS

Extended European Search Report for European Application No. 18925076.4 dated Jul. 19, 2021 (10 pages).

*Primary Examiner* — Audrey B. Walter
*Assistant Examiner* — Dapinder Singh
(74) *Attorney, Agent, or Firm* — Brandon V. Zuniga; James R. Gourley; Carstens & Cahoon, LLP

(57) ABSTRACT

Scroll compressor and a vehicle having the same. The scroll compressor includes: a support and an orbiting scroll assembly, the orbiting scroll assembly being movably provided on the support; a partition structure, provided between the support and the orbiting scroll assembly, a first bearing chamber being formed between the partition structure and the orbiting scroll assembly, a second bearing chamber being formed between the partition structure and the support, the orbiting scroll assembly being provided with a first through hole in communication with the first bearing chamber, and
(Continued)

the support being provided with a second through hole in communication with the second bearing chamber; and a first crankshaft), passing through the partition structure, a first communication passage through which the first bearing chamber is in communication with the second bearing chamber is formed between the first crankshaft and the partition structure.

20 Claims, 4 Drawing Sheets

(56) References Cited

U.S. PATENT DOCUMENTS

| | | | | |
|---|---|---|---|---|
| 2007/0231174 | A1* | 10/2007 | Ishizuki ..... | F04C 18/0215<br>418/55.3 |
| 2013/0149179 | A1 | 6/2013 | Sato et al. | |

FOREIGN PATENT DOCUMENTS

| | | | |
|---|---|---|---|
| CN | 106151046 | A | 11/2016 |
| CN | 108757445 | A | 11/2018 |
| CN | 108757446 | A | 11/2018 |
| CN | 108953145 | A | 12/2018 |
| EP | 1582693 | A1 | 10/2005 |
| EP | 3222851 | A1 | 9/2017 |
| JP | H09228966 | A | 9/1997 |
| JP | 10-2287 | | 1/1998 |
| JP | 2002227779 | A | 8/2002 |

* cited by examiner

SCROLL COMPRESSOR AND VEHICLE HAVING THE SAME

CROSS REFERENCE TO RELATED APPLICATION

The present application claims priority to Chinese Patent Application No. 201810717749.6, entitled "Scroll Compressor and Vehicle Having The Same", filed on Jul. 3, 2018, the content of which is expressly incorporated herein by reference in its entirety. This application is a national phase under 35 U.S.C. § 120 of international patent application PCT/CN2018/120640, entitled "Scroll Compressor and Vehicle Having Same" filed on Dec. 12, 2018, published as WO 2020/006985 A1 on Jan. 9, 2020. Every patent application and publication listed in this paragraph is hereby incorporated by reference in its entirety.

TECHNICAL FIELD

The present disclosure relates to the field of compressors, and particularly to a scroll compressor and a vehicle having the same.

BACKGROUND

Unlubricated scroll compressors are widely used in the braking field of new energy vehicles because the unlubricated scroll compressors can implement unlubricated compression and have characteristics of a high efficiency, a small size, a light weight, and a stable operation, etc. Generally, a scroll compressor consists of a housing, a fixed scroll, an orbiting scroll, a support, a crankshaft, an anti-rotation mechanism, and a motor. Both profile lines of the orbiting scroll and fixed scroll are a spiral shape. The orbiting scroll is eccentrically mounted relative to the fixed scroll by 180° degrees. Therefore, a plurality of crescent spaces are formed between the orbiting scroll and fixed scroll. When the orbiting scroll performs, by using the center of the fixed scroll as a rotation center and having a specific rotation radius, a rotational translational motion without a rotation, crescent spaces at the outer ring constantly move to the center. In this case, the air is gradually pushed to a central space, and a volume of the central space is constantly reduced, but the pressure is constantly increased until the central space is in communication with a central exhaust vent. The high-pressure air is discharged from a pump body, then a compression process is completed.

As a core component of the unlubricated scroll compressor, the current most common anti-rotation mechanism has a structure combining a mini crank and a rolling bearing, and the existing technology is patented as follows.

The patent with a publication number CN102971535B discloses a commonly used anti-rotation structure, in which a mini crank has an eccentric structure, and an eccentricity of the mini crank is the same as that of a spindle. There are two angular contact rolling bearings at each end of the crank, and two sets of bearings are respectively installed in a drive plate bearing chamber and a frame bearing chamber. Because the bearing needs to be lubricated with a grease, a grease hole is provided on the housing. When the lubricating grease is needed, the fixed scroll is removed, and the grease is supplied to the bearing chamber through the grease hole. The patent with a publication number CN100347449C discloses a scroll fluid machine in which an anti-rotation lubricating structure is formed by passing through a support plate located in front of the anti-rotation device.

In the existing technical solutions disclosed in the above-mentioned patents, each bearing chamber is isolated and independent from each other, and the lubricating grease needs to be separately injected. In addition, during maintenance, the bearing chambers need to be at least completely disassembled to complete the work of changing the lubricating grease.

SUMMARY

The present disclosure is intended to provide a scroll compressor and a vehicle having the same, to solve the problem of low efficiency and cumbersome operations of the maintenance work in the prior art.

To implement the above-mentioned objectives, according to an aspect of the present disclosure, a scroll compressor is provided and includes: a support and an orbiting scroll assembly, the orbiting scroll assembly being movably provided on the support; a partition structure, provided between the support and the orbiting scroll assembly, a first bearing chamber being formed between the partition structure and the orbiting scroll assembly, a second bearing chamber being formed between the partition structure and the support, the orbiting scroll assembly being provided with a first through hole in communication with the first bearing chamber, and the support being provided with a second through hole in communication with the second bearing chamber; and a first crankshaft passing through the partition structure, a first communication passage through which the first bearing chamber is in communication with the second bearing chamber being formed between the first crankshaft and the partition structure.

Further, the first crankshaft includes a first rotating shaft, a second rotating shaft, and a connecting structure; the connecting structure is provided between the first rotating shaft and the second rotating shaft, a first bearing is provided in the first bearing chamber, the first rotating shaft passes through the first bearing, a second bearing is provided in the second bearing chamber, the second rotating shaft passes through the second bearing, the connecting structure passes through the partition structure, the first communication passage through which the first bearing chamber is in communication with the second bearing chamber is formed between the connecting structure and the partition structure, the first through hole is in communication with the first communication passage through a passage of the first bearing, and the second through hole is in communication with the first communication passage through a passage of the second bearing.

Further, the orbiting scroll assembly is provided with a first receiving groove, the first bearing chamber is formed between the first receiving groove and the partition structure, the first through hole is provided on a bottom wall of the first receiving groove, the bottom wall is provided with a groove, and the first through hole is in communication with the passage of the first bearing through the groove.

Further, the orbiting scroll assembly includes a drive plate and an orbiting scroll which are fixedly connected, the drive plate is provided between the support and the orbiting scroll, the first receiving groove is provided on a side of the drive plate facing the support, the scroll compressor further includes a second crankshaft, and the second crankshaft passes through the drive plate to drive the drive plate and the orbiting scroll to move.

Further, a side of the orbiting scroll facing the drive plate is provided with a plurality of ribs.

Further, the scroll compressor further includes a fixed scroll, a compression chamber is formed between the orbiting scroll and the fixed scroll, and a side of the fixed scroll away from the compression chamber is provided with a plurality of ribs.

Further, the first through hole is detachably provided with a first lubricating nipple.

Further, the support is provided with a second receiving groove, the second bearing chamber is formed between the second receiving groove and the partition structure, and the second through hole is provided on a bottom wall of the second receiving groove.

Further, a diameter of the second through hole is greater than an outer diameter of an inner ring of the second bearing, to make the second through hole connected to the passage of the second bearing.

Further, the support is further detachably provided with an end cover, and when the end cover is fixedly mounted on the support, the end cover is capable of covering the second through hole.

Further, the end cover is provided with a third through hole, and a second lubricating nipple is detachably provided in the third through hole.

Further, the scroll compressor further includes a second crankshaft, the second crankshaft passes through the orbiting scroll assembly to drive the orbiting scroll assembly to move, the orbiting scroll assembly is provided with a third bearing chamber, the second crankshaft is provided with a third lubricating nipple and a second communication passage, the third lubricating nipple is in communication with the third bearing chamber through the second communication passage, the orbiting scroll assembly is provided with a fourth through hole, and the second communication passage is in communication with the fourth through hole through a passage of a third bearing in the third bearing chamber.

Further, the second crankshaft includes a spindle, a pin, and an eccentric block, the pin is eccentrically provided on the spindle and passes through the orbiting scroll assembly, the eccentric block is eccentrically provided on the spindle, and the second communication passage includes a first passage section provided on the eccentric block and a second passage section provided on the pin.

Further, the second passage section includes one axial blind hole provided in an axial direction of the pin and multiple radial through holes provided in a radial direction of the pin, the axial blind hole is in communication with the first passage section through one of the multiple radial through holes, and the axial blind hole is in communication with the passage of the third bearing through the remaining radial through holes.

Further, the orbiting scroll assembly includes a drive plate and an orbiting scroll which are fixedly connected, the drive plate is provided between the support and the orbiting scroll, and the pin passes through the drive plate.

Further, a fifth through hole is provided at a position on the orbiting scroll corresponding to the fourth through hole, and a hollow shaft passes through the fourth through hole and the fifth through hole, to fixedly connect the drive plate and the orbiting scroll.

Further, a sealing member is provided in the fifth through hole.

Further, a side of the orbiting scroll facing the drive plate is provided with a plurality of ribs.

Further, the scroll compressor further includes a fixed scroll, a compression chamber is formed between the orbiting scroll and the fixed scroll, and a side of the fixed scroll away from the compression chamber is provided with a plurality of ribs.

According to another aspect of the present disclosure, a vehicle is provided, which includes the above-mentioned scroll compressor.

By using the technical solution of the present disclosure, the first bearing chamber is in communication with the second bearing chamber through the first communication passage, so that a cavity is formed. When a lubricating grease is injected into the scroll compressor, the lubricating grease may be sequentially injected into the first bearing chamber and the second bearing chamber through the first through hole, which saves time of changing an lubricating opening, and detaching and mounting an lubricating device, and improves the lubricating efficiency to some extent. In addition, the first through hole and the second through hole are used as an inlet and outlet of the cavity, such that when performing the lubricating for the first time, a worker can inject, through the first through hole, the lubricating grease into the cavity formed through the communication between the first bearing chamber and the second bearing chamber, and air in the cavity can be discharged from the cavity through the second through hole, thereby preventing the air in the cavity from forming a high pressure due to compression which prevents the cavity from filling with the grease and affects the lubrication effect. During subsequent maintenance, it is not necessary to disassemble the cavity, and the lubricating grease can still be injected from the first through hole, so that waste grease can be extruded out of the cavity through the second through hole. In such a way, a maintenance operation is simplified, which greatly improves the work efficiency of changing the grease. Meanwhile, there is no need to disassemble the scroll compressor during the grease changing, so that the worker can increase the maintenance frequency according to requirements, and ensure the working effect of the scroll compressor.

BRIEF DESCRIPTION OF THE DRAWINGS

The accompanying drawings that constitute a part of the present disclosure are used for providing a further understanding of the present disclosure. Exemplary embodiments of the present disclosure and descriptions of the embodiments are used for describing the present disclosure, and do not constitute any inappropriate limitation to the present disclosure. In the drawings.

Figure 1:
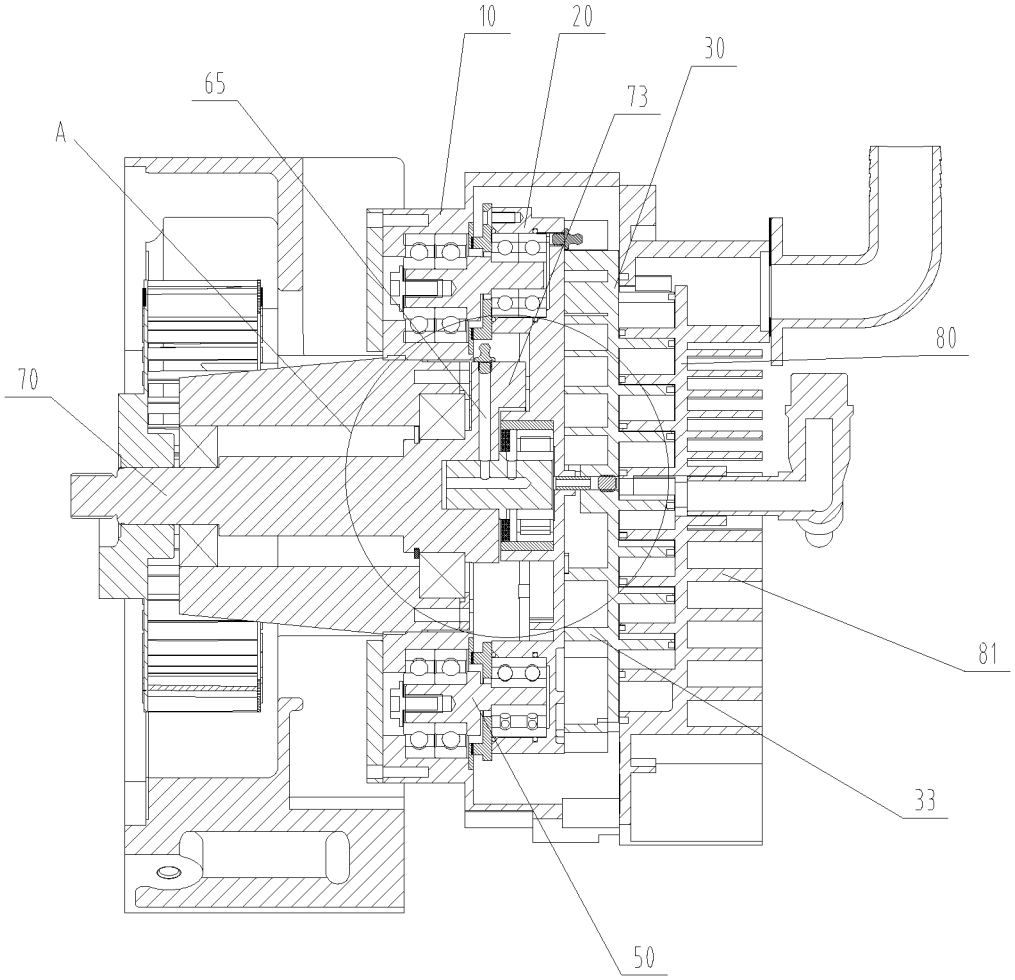
FIG. 1 is a schematic structure diagram illustrating a scroll compressor according to an embodiment I of the present disclosure.

The accompanying drawings include the following reference signs:

10, support; 11, second through hole; 20, drive plate; 21, first through hole; 22, groove; 23, fourth through hole; 30, orbiting scroll; 31, fifth through hole; 32, sealing member; 33, reinforcing rib; 40, partition structure; 41, first partition member; 42, second partition member; 50, first crankshaft; 51, first rotating shaft; 52, second rotating shaft; 53, connecting structure; 61, first bearing; 62, second bearing; 63, third bearing; 64, first communication passage; 65, second communication passage; 651, first passage section; 652, axial blind hole; 653*a*, radial through hole; 653*b*, radial through hole; 66, first lubricating nipple; 67, second lubricating nipple; 68, third lubricating nipple; 69, hollow shaft; 70, second crankshaft; 71, spindle; 72, pin; 73, eccentric block; 80, fixed scroll; 81, reinforcing rib; 91, end cover; 92, third through hole.

DETAILED DESCRIPTION

The technical solutions in the embodiments of the present disclosure are clearly and completely described below with reference to the accompanying drawings in the embodiments of the disclosure. Apparently, the embodiments described herein are merely some embodiments of the disclosure rather than all of the embodiments. In fact, the following description for at least one exemplary embodiment is merely illustrative, and in no way constitutes any limitation to the present disclosure and disclosure or use thereof. All other embodiments obtained by a person of ordinary skill in the art based on the embodiments of the present disclosure without any creative work shall fall within the protection scope of the present disclosure.

It should be noted that, terms used herein are only for describing specific implementations and are not intended to limit the exemplary implementations according to the present disclosure. As used herein, the singular form is also intended to include the plural form unless the context clearly dictates otherwise. In addition, it should be further understood that, terms "comprise" and/or "include" used in the specification indicate that there are features, steps, operations, devices, components, and/or combinations thereof.

Unless otherwise specified, the relative deployment, the numerical expressions, and values of the components and steps described in the embodiments do not limit the scope of the present disclosure. In addition, it should be understood that, for convenient description, sizes of parts shown in the accompanying drawings are not drawn according to an actual proportional relationship. Technologies, methods, and devices known to a person of ordinary skill in the art may not be discussed in detail, but in proper circumstances, these technologies, methods, and devices shall be regarded as a part of the specification. In all examples that are shown and discussed herein, any specific value should be interpreted only as an example and not as a constraint. Therefore, other examples of the exemplary embodiments may have different values. It should be noted that: similar reference signs or letters in the accompanying drawings indicate similar items. Therefore, once an item is defined in one accompanying drawing, the item does not need to be further discussed in the subsequent accompanying drawings.

Figure 2:
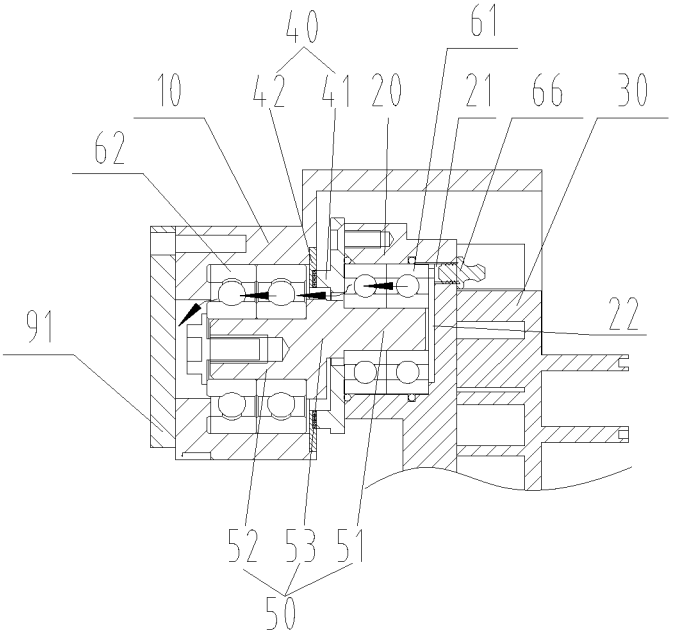
FIG. 2 is a partial enlarged schematic structure diagram illustrating a first bearing chamber and a second bearing chamber of the scroll compressor in FIG. 1.

As shown in FIG. 1 and FIG. 2, a scroll compressor according to Embodiment I of the present disclosure includes a support 10, an orbiting scroll assembly, a partition structure 40, and a first crankshaft 50. The orbiting scroll assembly is movably provided on the support 10; the partition structure 40 is provided between the support 10 and the orbiting scroll assembly; and the first crankshaft 50 passes through the partition structure 40. A first bearing chamber is formed between the partition structure 40 and the orbiting scroll assembly; a second bearing chamber is formed between the partition structure 40 and the support 10; the orbiting scroll assembly is provided with a first through hole 21 in communication with the first bearing chamber; and the support 10 is provided with a second through hole 11 in communication with the second bearing chamber. A first communication passage 64 through which the first bearing chamber is in communication with the second bearing chamber is formed between the first crankshaft 50 and the partition structure 40.

By applying the technical solution of the embodiment, the first bearing chamber is in communication with the second bearing chamber through the first communication passage 64, so that a cavity is formed. When lubricating grease is injected into the scroll compressor, the lubricating grease can be sequentially injected into the first bearing chamber and the second bearing chamber through the first through hole 21, which saves time of changing a lubricating opening, and detaching and mounting a lubricating device, and improves the lubricating efficiency to some extent. Meanwhile, the first through hole 21 and the second through hole 11 are used as an inlet and outlet of the cavity, such that when lubricating for the first time, a worker can inject, through the first through hole 21, the lubricating grease into the cavity formed through communication between the first bearing chamber and the second bearing chamber, and air in the cavity can be discharged from the cavity through the second through hole 11, thereby preventing the air in the cavity from forming a high pressure due to compression which prevents the cavity from filling with the grease and affects the lubrication effect. During subsequent maintenance, it is not necessary to disassemble the cavity, and the lubricating grease can still be injected from the first through hole 21. New grease flows from the first bearing chamber to the second bearing chamber under the action of pressure, and sequentially fills a gap in the first bearing chamber and a gap in the second bearing chamber. Accordingly, the waste grease can be extruded out of the cavity by the new grease through the second through hole 11. The above-mentioned operation simplifies a maintenance operation, and greatly improves the work efficiency of changing grease; meanwhile, since there is no need to disassemble the processor in the process of changing grease, the worker may improve the maintenance frequency according to requirements, to ensure the work effect of the scroll compressor.

Specifically, as shown in FIG. 2, the first crankshaft 50 in the embodiment includes a first rotating shaft 51, a second rotating shaft 52, and a connecting structure 53. The connecting structure 53 is provided between the first rotating shaft 51 and the second rotating shaft 52. A first bearing 61 is provided in the first bearing chamber, the first rotating shaft 51 passes through the first bearing 61; a second bearing 62 is provided in the second bearing chamber, the second rotating shaft 52 passes through the second bearing 62, and the connecting structure 53 passes through the partition structure 40. The first communication passage 64 through which the first bearing chamber is in communication with the second bearing chamber is formed between the connecting structure 53 and the partition structure 40. The first through hole 21 is connected to the first communication passage 64 through a passage of the first bearing 61, and the second through hole 11 is connected to the first communication passage 64 through a passage of the second bearing 62. The passage of the first bearing 61 and the passage of the second bearing 62 refer to a gap or a hole in a bearing structure for the grease to pass through. A roller bearing is taken as an example, a specific gap exists among an inner ring, an outer ring and a roller of the bearing for the grease to pass through.

As shown in FIG. 2, the partition structure 40 in the embodiment includes a first partition member 41 and a second partition member 42. The first bearing chamber is formed between the first partition member 41 and a first receiving groove provided on the orbiting scroll assembly, the first through hole 21 is provided on a bottom wall of the first receiving groove, and the first through hole 21 is detachably provided with a first lubricating nipple 66. A second bearing chamber is formed between the second partition member 42 and a second receiving groove provided on the support 10, and the second through hole 11 is provided on a bottom wall of the second receiving groove. The support 10 is further detachably provided with an end cover 91. When the end cover 91 is fixedly mounted on the support 10, the end cover 91 is capable of covering the second through hole 11, such that the second bearing chamber forms a closed cavity. When the grease is injected, the end cover 91 is detached to expose the second through hole 11, and new lubricating grease is injected into the first bearing chamber through the first lubricating nipple 66 under the action of pressure, and flows from the first bearing chamber to the second bearing chamber, to fill a gap in the first bearing chamber and a gap in the second bearing chamber. This moment, the old grease can be discharged from the second through hole 11 under the action of the pressure of the new grease. After the lubricating is completed, the end cover 91 is mounted to block the second through hole 11. This moment, the first lubricating nipple 66 can function as a one-way valve, so that the lubricating grease cannot flow out of the first bearing chamber from the first through hole 21.

Further, the passage of the first bearing 61 is substantially annular. In order to make the first through hole 21 fully in communication with the passage, as shown in FIG. 1, the bottom wall of the first receiving groove in the embodiment is provided with a groove 22. The first through hole 21 is provided off an axis of the first bearing 61 and is in communication with the passage of the first bearing 61 through the groove 22. In some embodiments, the groove 22 may be a circular groove coaxial with the first bearing 61, or an annular groove corresponding to the annular passage of the first bearing 61.

The scroll compressor in the embodiment is provided with a fastener at a position of the second through hole 11 to fix the second bearing 62. In the embodiment, a diameter of the second through hole 11 is greater than an outer diameter of the inner ring of the second bearing 62, so that the second through hole 11 is in communication with the passage of the second bearing 62.

As shown in FIG. 1 and FIG. 2, the scroll compressor in the embodiment further includes a fixed scroll 80. The orbiting scroll assembly includes a drive plate 20 and an orbiting scroll 30 which are fixedly connected. The drive plate 20 is provided between the support 10 and the orbiting scroll 30, a compression chamber is formed between the orbiting scroll 30 and the fixed scroll 80, and the first receiving groove is disposed on a side of the drive plate 20 facing the support 10.

As shown in FIG. 1, in the embodiment, a side of the orbiting scroll 30 facing the drive plate 20 is provided with a plurality of reinforcing ribs 33. A side of the fixed scroll 80 away from the compression chamber is provided with a plurality of reinforcing ribs 81. On one hand, the reinforcing ribs 33 and the reinforcing ribs 81 increase contact areas between the orbiting scroll 30 and the air, and between the fixed scroll 80 and the air, and can improve the heat dissipation effect during the operation of the compressor. On the other hand, the structural strengths of the orbiting scroll 30 and the fixed scroll 80 are improved.

As shown in FIG. 1, the scroll compressor in the embodiment further includes a second crankshaft 70. The second crankshaft 70 includes a spindle 71, a pin 72, and an eccentric block 73. The pin 72 is eccentrically provided on the spindle 71 and passes through the drive plate 20 to drive the drive plate 20 and the orbiting scroll 30 to move. The eccentric block 73 is eccentrically provided on the spindle 71, to balance the operation of the scroll compressor. The drive plate 20 is provided with a third bearing chamber, and the second crankshaft 70 is provided with a third lubricating nipple 68 and a second communication passage 65. The third lubricating nipple 68 is in communication with the third bearing chamber through the second communication passage 65, the drive plate 20 is provided with a fourth through hole 23, and the second communication passage 65 is in communication with the fourth through hole 23 through a passage of a third bearing 63 in the third bearing chamber. Through the second communication passage 65, the lubricating grease injected from the third lubricating nipple 68 can first fill a first side of the third bearing 63, and then flows to a second side of the third bearing 63 through the passage of the third bearing 63, to make the lubricating grease fully lubricate the third bearing.

Figure 4:
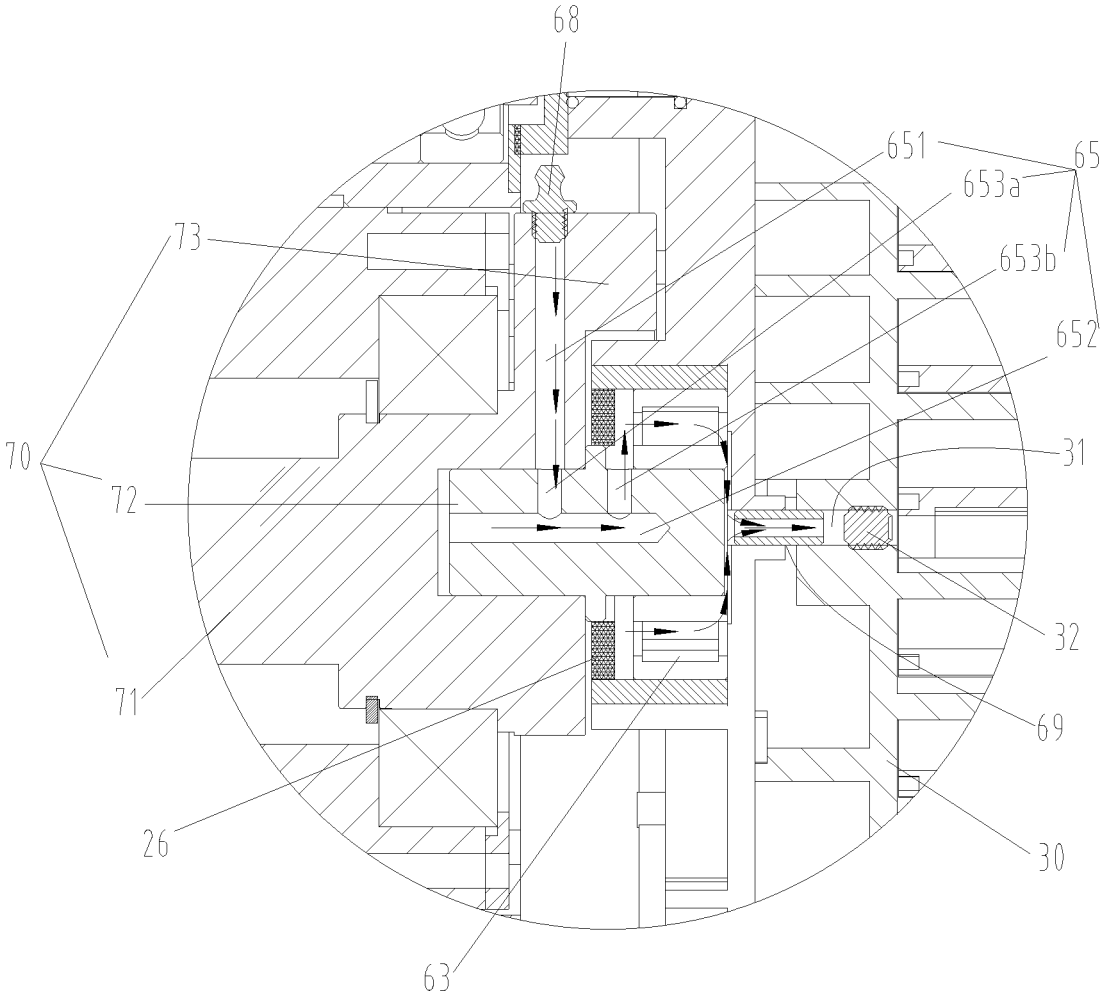
FIG. 4 is a partial enlarged schematic diagram of a portion "A" of the scroll compressor in FIG. 1.
Figure 5:
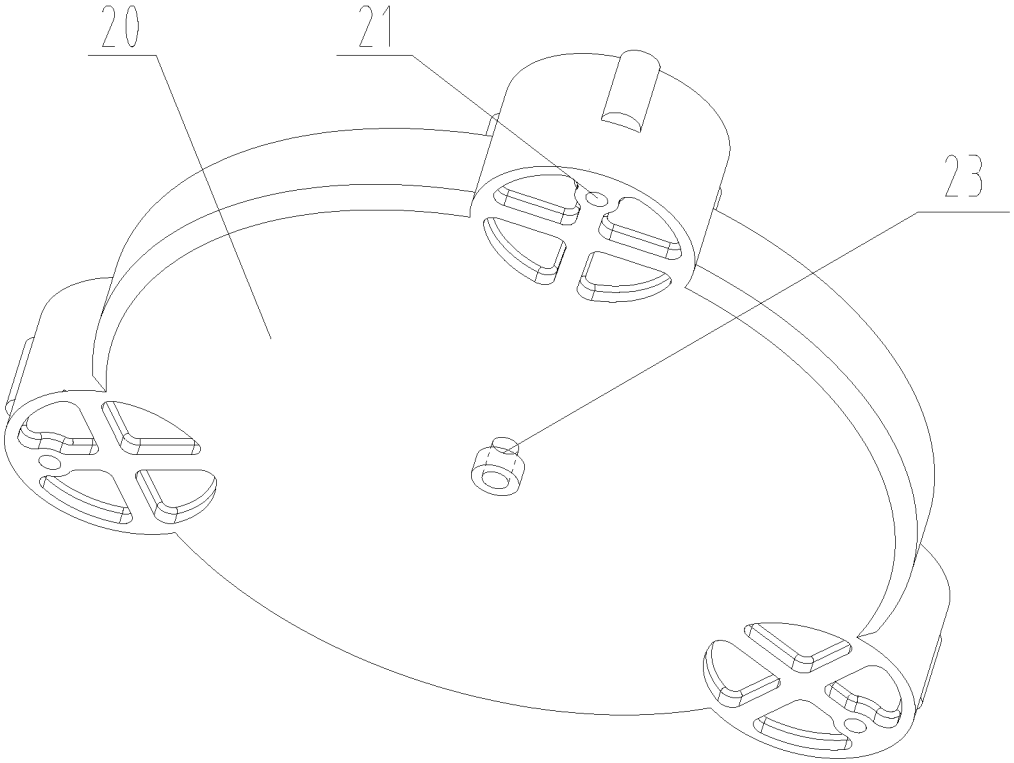
FIG. 5 is a schematic structure diagram illustrating a drive plate of the scroll compressor in FIG. 1.

Specifically, as shown in FIG. 4 and FIG. 5, the second communication passage 65 in the embodiment includes a first passage section 651 provided on the eccentric block 73 and a second passage section provided on the pin 72. In the scroll compressor in the embodiment, the third lubricating nipple 68 can be exposed by changing the angle of the eccentric block 73 through the rotation. In such a way, a lubricating operation can be simplified, and the maintenance efficiency is improved.

In some embodiments, the second passage section in the embodiment includes one axial blind hole 652 provided in an axial direction of the pin 72 and multiple radial through holes provided in a radial direction of the pin 72. An opening of the axial blind hole 652 is provided toward the spindle 71, the axial blind hole 652 is in communication with the first passage section 651 through one of multiple radial through holes 653*a*, and the axial blind hole 652 is in communication with the passage of the third bearing 63 through the remaining radial through holes 653*b*. The above-mentioned structure is convenient for processing and is conducive to improving the production efficiency.

As shown in FIG. 5, in the embodiment, a position on the orbiting scroll 30 corresponding to the fourth through hole 23 is provided with a fifth through hole 31, and a hollow shaft 69 passes through the fourth through hole 23 and the fifth through hole 31, to fixedly connect the drive plate 20 and the orbiting scroll 30 and make the lubricating grease discharged from a hollow pipe of the hollow shaft 69. A sealing member 32 is provided in the fifth through hole 31 to prevent the lubricating grease from flowing into the compression chamber between the orbiting scroll 30 and the fixed scroll 80.

Figure 3:
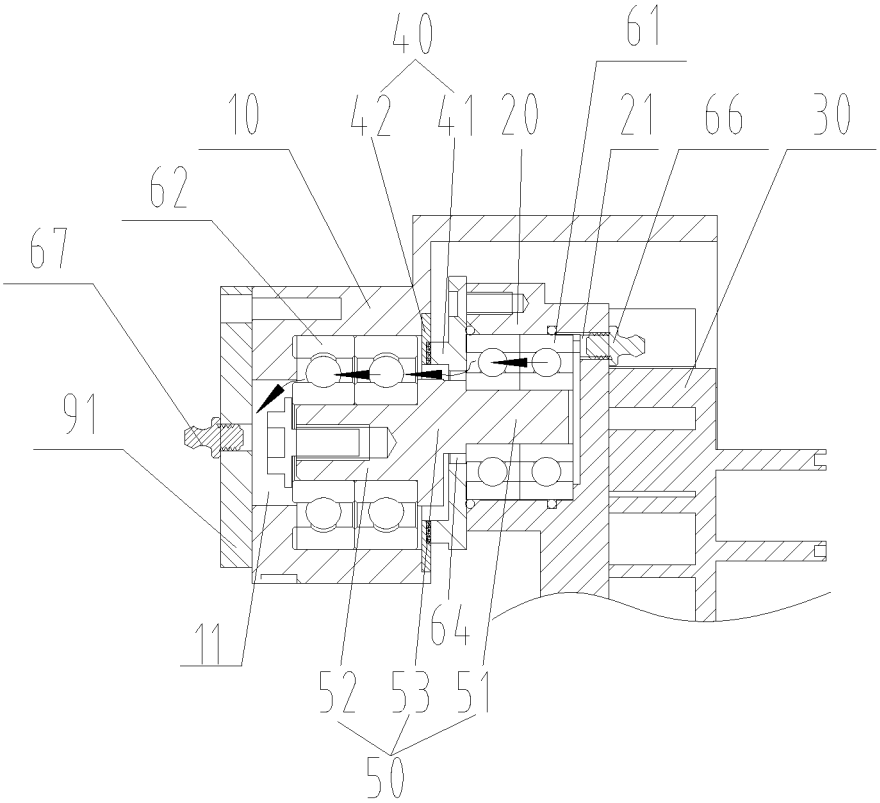
FIG. 3 is a partial enlarged schematic structure diagram illustrating a first bearing chamber and a second bearing chamber of a scroll compressor according to an embodiment II of the present disclosure.

In the scroll compressor according to the embodiment II of the disclosure, a structure of the cavity formed through the communication between the first bearing chamber and the second bearing chamber is improved. Specifically, as shown in FIG. 3, in the embodiment, the end cover 91 is provided with the third through hole 92, and the third through hole 92 is detachably provided with a second lubricating nipple 67. Because of the third through hole 92 and the second lubricating nipple 67, a worker has no need to detach the entire end cover 91 when performing the grease change and maintenance work, and can open the cavity formed through the communication between the first bearing chamber and the second bearing chamber by simply detaching the second lubricating nipple 67, to complete the work of lubricating grease injection and lubricating grease discharging. In addition, by using the above-mentioned structure, in the scroll compressor in the embodiment, the second lubricating nipple 67 can be detached, and the grease is injected into the cavity through the first lubricating nipple 66 and is discharged from the third through hole 92; alternatively, the first lubricating nipple 66 can be detached, and the grease is injected into the cavity through the second lubricating nipple 67 and is discharged from the first through hole 21, accordingly the maintenance becomes more flexible.

The present disclosure further provides a vehicle (not shown in the figures) which includes a scroll compressor according to the embodiments of present disclosure. The scroll compressor includes all or some of the structural components of the scroll compressor in the above embodiments, and the vehicle in the embodiment has characteristics of a simple operation and a high efficiency in the maintenance of the scroll compressor.

It can be seen from the aforementioned description that the embodiments of the present disclosure achieve the following technical effects.

The first bearing chamber is in communication with the second bearing chamber through the first communication passage, so that a cavity is formed. When the lubricating grease is injected into the scroll compressor, the lubricating grease can be sequentially injected into the first bearing chamber and the second bearing chamber through the first through hole, which saves time of changing a lubricating opening and detaching and mounting a lubricating device, and improves the lubricating efficiency to some extent. In addition, the first through hole and the second through hole are used as an inlet and outlet of the cavity, such that when performing the lubricating for the first time, a worker can inject, through the first through hole, the lubricating grease into the cavity formed through the communication between the first bearing chamber and the second bearing chamber, and air in the cavity can be discharged from the cavity through the second through hole, thereby preventing the air in the cavity from forming a high pressure due to compression which prevents the cavity from filling with the grease and affects the lubrication effect. During subsequent maintenance, there is no need to open the cavity, and the lubricating grease can still be injected from the first through hole, so that the waste grease can be extruded out of the cavity through the second through hole. In such a way, a maintenance operation is simplified, which greatly improves the work efficiency of changing the grease. In addition, the scroll compressor does not need to be disassembled during the grease changing, so that the worker can increase the maintenance frequency according to requirements, to ensure the working effect of the scroll compressor.

In the description of the present disclosure, it should be understood that orientation or position relationships indicated by orientation terms such as "front, rear, upper, lower, left, and right", "transverse, vertical, perpendicular, and horizontal", and "top, and bottom" are based on the orientation or position relationships shown in the accompanying drawings, and are used only for ease and brevity of illustration and description of the disclosure. Unless otherwise stated, the orientation terms do not indicate or imply that the mentioned apparatus or element needs to have a particular orientation or needs to be constructed and operated in a particular orientation. Therefore, such terms should not be construed as limiting the protection scope of the present disclosure. The orientation terms such as "inside, outside" refer to the inside and outside of outlines of the components.

For convenient description, space-related terms, such as "over", "above", "on an upper surface", and "upper", may be used herein for describing a spatial location relationship between one device or feature and another device or feature as shown in the figures. It should be understood that, the space-related terms are intended to encompass different orientations of the device in use or operation other than the orientations described in the figures. For example, if the devices in the accompanying drawings are reversed, the devices that are described as "above another device or structure" or "on another device or structure" are defined as "below another device or structure" or "under another device or structure". Therefore, the exemplary term "above" may include two orientations: "above" and "below". The device may alternatively be positioned in other different manners (rotating by 80 degrees or being located at other orientations), and space-related descriptions used herein are explained correspondingly.

In addition, it should be noted that, the terms such as "first", and "second" are used for defining parts to merely make it easier to distinguish the corresponding parts. Unless otherwise stated, the terms have no special meanings, and therefore cannot be construed as limiting the protection scope of the present disclosure The foregoing descriptions are merely preferred embodiments of the present disclosure, but are not intended to limit the present disclosure. A person skilled in the art can make various modifications and variations to the present disclosure. Any modification, equivalent replacement, or improvement made within the spirit and principle of the present disclosure shall fall within the protection scope of the present disclosure.

What is claimed is:

1. A scroll compressor, comprising:

a support and an orbiting scroll assembly, wherein the orbiting scroll assembly is movably provided on the support;

a partition structure, provided between the support and the orbiting scroll assembly, wherein a first bearing chamber is formed between the partition structure and the orbiting scroll assembly, a second bearing chamber is formed between the partition structure and the support, the orbiting scroll assembly is provided with a first through hole in communication with the first bearing chamber, and the support is provided with a second through hole in communication with the second bearing chamber; and a first crankshaft, passing through the partition structure, wherein a first communication passage through which the first bearing chamber is in communication with the second bearing chamber is formed between the first crankshaft and the partition structure.

2. The scroll compressor according to claim 1, wherein the first crankshaft comprises a first rotating shaft, a second rotating shaft, and a connecting structure, the connecting structure is provided between the first rotating shaft and the second rotating shaft, a first bearing is provided in the first bearing chamber, the first rotating shaft passes through the first bearing, a second bearing, is provided in the second bearing chamber, the second rotating shaft passes through the second bearing, the connecting structure passes through the partition structure, the first communication passage through which the first bearing chamber is in communication with the second bearing chamber is formed between the connecting structure -and the partition structure the first through hole is connected to the first communication passage through a passage of the first bearing, and the second through hole is connected to the first communication passage through a passage of the second bearing.

3. The scroll compressor according to claim 2, wherein the orbiting scroll assembly is provided with a first receiving groove, the first bearing chamber is formed between the first receiving groove and the partition structure, the first through hole is provided on a bottom wall of the first receiving groove, the bottom wall is provided with a groove and the first through hole is connected to the passage of the first bearing through the groove.

4. The scroll compressor according to claim 3, wherein the orbiting scroll assembly comprises a drive plate and an orbiting scroll which are fixedly connected, the drive plate is provided between the support and the orbiting scroll, the first receiving groove is provided on a side of the drive plate facing the support, the scroll compressor further comprises a second crankshaft, and the second crankshaft passes through the drive plate to drive the drive plate and the orbiting scroll to move.

5. The scroll compressor according to claim 4, wherein a side of the orbiting scroll facing the drive plate is provided with a plurality of ribs.

6. The scroll compressor according to claim 5, wherein the scroll compressor further comprises a fixed scroll, a compression chamber is formed between the orbiting scroll and the fixed scroll, and a side of the fixed scroll away from the compression chamber is provided with a plurality of ribs.

7. The scroll compressor according to claim 2, wherein the support is provided with a second receiving groove, the second bearing chamber is formed between the second receiving groove and the partition structure, and the second through hole is provided on a bottom wall of the second receiving groove.

8. The scroll compressor according to claim 7, wherein a diameter of the second through hole is greater than an outer diameter of an inner ring of the second bearing to make the second through hole connected to the passage of the second bearing.

9. The scroll compressor according to claim 7, wherein the support is further detachably provided with an end cover, and when the end cover is fixedly mounted on the support, the end cover is capable of covering the second through hole.

10. The scroll compressor according to claim 9, wherein the end cover is provided with a third through hole, and a second lubricating nipple is detachably provided in the third through hole.

11. The scroll compressor according to claim 1, wherein the first through hole is detachably provided with a first lubricating nipple.

12. The scroll compressor according to claim 1, wherein the scroll compressor further comprises a second crankshaft, the second crankshaft passes through the orbiting scroll assembly to drive the orbiting scroll assembly to move, the orbiting scroll assembly is provided with a third bearing chamber, the second crankshaft is provided with a third lubricating nipple and a second communication passage, the third lubricating nipple is in communication with the third bearing chamber through the second communication passage, the orbiting scroll assembly is provided with a fourth through hole, and the second communication passage is in communication with the fourth through hole through a passage of a third bearing in the third bearing chamber.

13. The scroll compressor according to claim 12, wherein the second crankshaft comprises a spindle a pin, and an eccentric block, the pin is eccentrically provided on the spindle and passes through the orbiting scroll assembly, the eccentric block is eccentrically provided on the spindle, and the second communication passage comprises a first passage section provided on the eccentric block and a second passage section provided on the pin.

14. The scroll compressor according to claim 13, wherein the second passage section comprises one axial blind hole provided in an axial direction of the pin and multiple radial through holes provided in a radial direction of the pin, the axial blind hole is in communication with the first passage section through one of the multiple radial through holes, and the axial blind hole is in communication with the passage of the third bearing through the remaining radial through holes.

15. The scroll compressor according to claim 13, wherein the orbiting scroll assembly comprises a drive plate and an orbiting scroll which are fixedly connected, the drive plate is provided between the support and the orbiting scroll, and the pin passes through the drive plate.

16. The scroll compressor according to claim 15, wherein a fifth through hole is disposed at a position on the orbiting scroll corresponding to the fourth through hole, and a hollow shaft passes through the fourth through hole and the fifth through hole, to fixedly connect the drive plate and the orbiting scroll.

17. The scroll compressor according to claim 16, wherein a sealing member is provided in the fifth through hole.

18. The scroll compressor according to claim 15, wherein a side of the orbiting scroll facing the drive plate is provided with a plurality of ribs.

19. The scroll compressor according to claim 15, further comprising a fixed scroll, wherein a compression chamber is formed between the orbiting scroll and the fixed scroll, and a side of the fixed scroll away from the compression chamber is provided with a plurality of ribs.

20. A vehicle, comprising the scroll compressor according to claim 1.

* * * * *